US011801407B2

(12) United States Patent
Hart et al.

(10) Patent No.: US 11,801,407 B2
(45) Date of Patent: Oct. 31, 2023

(54) WALL-MOUNTABLE SPRAY HEAD UNIT

(71) Applicant: PLUMIS LTD., Perivale (GB)

(72) Inventors: Alan Hart, Cambridge (GB); William Makant, London (GB); Yusuf Muhammad, Sidcup (GB); Andrew Horst, London (GB); Mitchell Couper, Sevenoaks (GB)

(73) Assignee: PLUMIS LTD.

( * ) Notice: Subject to any disclaimer, the term of this patent is extended or adjusted under 35 U.S.C. 154(b) by 0 days.

(21) Appl. No.: 17/522,009

(22) Filed: Nov. 9, 2021

(65) Prior Publication Data

US 2022/0062678 A1 Mar. 3, 2022

Related U.S. Application Data

(63) Continuation of application No. 16/086,669, filed as application No. PCT/GB2017/051224 on May 2, 2017, now Pat. No. 11,167,160.

(30) Foreign Application Priority Data

May 5, 2016 (GB) ..... 1607903

(51) Int. Cl.

| | |
|---|---|
| ***A62C 35/68*** | (2006.01) |
| ***A62C 31/02*** | (2006.01) |
| ***A62C 37/09*** | (2006.01) |
| ***A62C 31/28*** | (2006.01) |
| ***A62C 37/40*** | (2006.01) |

(Continued)

(52) U.S. Cl.

CPC ..... *A62C 37/09* (2013.01); *A62C 31/28* (2013.01); *A62C 35/68* (2013.01); *A62C 37/36* (2013.01); *A62C 37/40* (2013.01); *A62C 31/02* (2013.01); *A62C 37/44* (2013.01)

(58) Field of Classification Search

CPC ..... A62C 37/09; A62C 37/44; A62C 35/68

See application file for complete search history.

(56) References Cited

U.S. PATENT DOCUMENTS 2,230,434 A * 2/1941 Porter ..... F16K 1/422 137/315.12
4,011,887 A * 3/1977 Raymond ..... F15B 13/0842 137/880

(Continued)

FOREIGN PATENT DOCUMENTS

GB 2 291 803 A 2/1996
GB 2 327 606 A 2/1999

(Continued)

OTHER PUBLICATIONS

Extended European Search Report, counterpart application No. 21214527.0-1113, dated Apr. 12, 2022, 9 pages.

(Continued)

*Primary Examiner* — Joseph A Greenlund

(74) *Attorney, Agent, or Firm* — Ware, Fressola, Maguire & Barber LLP

(57) ABSTRACT

A wall-mountable spray head unit is shown with a display and/or at least one user input device. The wall-mountable spray head unit is shown deployed in a fire suppression system that includes at least one or at least two wall-mounted spray head units capable of aiming and shooting fire suppressant liquid into a fire.

15 Claims, 16 Drawing Sheets

(51) Int. Cl.
*A62C 37/36* (2006.01)
*A62C 37/44* (2006.01)

(56) References Cited

U.S. PATENT DOCUMENTS

| | | | | |
|---|---|---|---|---|
| 4,206,778 | A * | 6/1980 | Gallo | F16K 5/0421 137/315.25 |
| 5,701,934 | A * | 12/1997 | Kuran | F16K 11/074 251/352 |
| 5,727,634 | A * | 3/1998 | Ishida | A62C 31/05 169/61 |
| 7,066,273 | B2 * | 6/2006 | Tan | A62C 37/40 169/41 |
| 7,861,947 | B1 * | 1/2011 | Watson, Sr. | B05B 15/74 239/281 |
| 8,448,715 | B2 * | 5/2013 | Munro | A62C 3/006 169/65 |
| 8,936,103 | B2 * | 1/2015 | Munro | E03C 1/04 169/65 |
| 8,944,174 | B2 | 2/2015 | Thomas et al. | |
| 9,393,451 | B2 * | 7/2016 | Broidy | A62C 35/20 |
| 11,027,161 | B2 * | 6/2021 | Meyer | B05B 1/267 |
| 2002/0190140 | A1 * | 12/2002 | Arenson | B05B 1/3006 239/391 |
| 2004/0129434 | A1 * | 7/2004 | Tan | A62C 37/40 239/69 |
| 2008/0142615 | A1 * | 6/2008 | Chen | B05B 12/008 239/74 |
| 2009/0188682 | A1 * | 7/2009 | Gensel | A62C 37/50 169/46 |
| 2012/0018179 | A1 * | 1/2012 | Munro | A62C 37/40 169/65 |
| 2013/0233578 | A1 * | 9/2013 | Munro | A62C 3/006 169/61 |
| 2014/0036132 | A1 * | 2/2014 | Pawlowski | B60S 1/0411 348/335 |
| 2014/0159910 | A1 * | 6/2014 | Lee | G08B 7/066 340/691.6 |
| 2015/0300729 | A1 * | 10/2015 | Seo | F25D 23/126 62/189 |
| 2016/0247373 | A1 * | 8/2016 | Muhammad | A62C 35/68 |
| 2016/0327298 | A1 * | 11/2016 | Sinha | F24F 11/63 |
| 2017/0319882 | A1 * | 11/2017 | Hart | A62C 31/03 |
| 2019/0099631 | A1 * | 4/2019 | Hart | A62C 37/36 |
| 2021/0299494 | A1 * | 9/2021 | Muhammad | A62C 31/24 |
| 2022/0280824 | A1 * | 9/2022 | Muhammad | A62C 99/0072 |

FOREIGN PATENT DOCUMENTS

| | | |
|---|---|---|
| JP | 2002 172184 A | 6/2002 |
| JP | 2012 152388 A | 8/2012 |
| WO | 2010/058183 A1 | 5/2010 |

OTHER PUBLICATIONS

Bibliographic data including English abstract for Foreign Patent Document Cite No. 1 (JP 2012 152388 A), 1 page.
International Search Report, International application No. PCT/GB2017/051224, dated Aug. 31, 2017, 6 pages.
English Abstract, JP 2002 172184 A, 1 page.
Chinese Search Report, application CN201780027917.2 (counterpart to US parent), report dated May 28, 2020, office action dated Jun. 3, 2020, 2 pages.
English Abstract, CN2276355Y, Bibliographic Data, 2 pages.
English Abstract, CN1079918A, Bibliographic Data, 2 pages.

* cited by examiner

Closed

WALL-MOUNTABLE SPRAY HEAD UNIT

FIELD OF THE INVENTION

The present invention relates to a wall-mountable spray head unit for a fire suppression system comprising at least one or at least two wall-mounted spray head units capable of aiming and shooting fire suppressant liquid into a fire.

BACKGROUND

Fire sprinklers and other suppression systems are required in homes by building codes and regulations in a number of parts of the world. In some locations such as England, their use allows more attractive or space-efficient layouts to be created or allows buildings where they would not otherwise be permitted. In other markets such as parts of the United States, all residences are required to be equipped with fire suppression.

With high housing costs in many urban areas, property developers work to maximize the use of space, which drives many projects towards considering fire suppression.

Some alternatives to domestic fire sprinkler systems are gaining popularity. For example one fire suppression system is marketed by Plumis Ltd. under the name "Automist". Such systems may offer a range of benefits. They may operate with much reduced water flow requirements compared to sprinkler systems. For example, an Automist system with a single pump draws approximately 5.6 litres per minute, whereas a more conventional sprinkler system might be specified to use over 100 litres per minute for the same room size. They may therefore create less water damage when activated. They may avoid the large one-off costs of a more conventional sprinkler system and therefore be more cost-effective when installed in a localized zone. They may be easier, faster, less disruptive and less expensive to retrofit to an existing property. They may have an aesthetically superior appearance when compared to a sprinkler system. They may allow retention of period features such as ceiling plasterwork. They may use less space than tank-based sprinkler systems and even avoid consequent structural reinforcements. Their lower water demand may create fewer uncertainties and dependencies, leading to a more predictable installation process and costs than would be the case with fire sprinklers.

These alternative suppression systems also have some disadvantages. Although they may provide adequate life safety for building occupants in many circumstances, their low water usage is a significant constraint and not all such systems provide fully equivalent performance to a full fire sprinkler system.

Residential and domestic fire suppression systems are usually installed in order to allow a property to comply with regulations. Since the alternative systems such as Automist are designed differently to conventional sprinkler systems, therefore do not follow existing standards such as BS 8458, BS9251 or BS9252, and may perform differently in fires, they are therefore difficult to compare with the better-known option of fire sprinklers. To date, this has limited the applicability of these alternative products, as people charged with enforcing the aforementioned regulations may not be able to come to a quick and complete decision regarding such products and in their doubt may insist on the use of conventional fire sprinklers in lieu of the alternative system that the consumer or property developer may prefer. For example, the Automist system is widely approved for building regulations purposes for use in certain types of open-plan three-story house, but much less widely in open plan apartments.

Despite the limitations on approval, alternative fire suppression systems have grown in popularity among consumers, architects and property developers. A key factor limiting the sale of such products is their lack of demonstrable equivalence to sprinklers in their fire performance. Therefore, an alternative fire suppression system should have a major advantage in the marketplace if it could retain the advantages mentioned above such as low flow, predictable installation complexity, reduced water damage, low cost, small size and non-disruptive installation, whilst achieving similar fire performance to conventional sprinklers.

Plumis Ltd. Has developed a fire suppression system ("Automist Smartscan") that only consumes 5.6 litres per minute of water yet achieves equivalent performance to a full domestic sprinkler system with much higher flows, by using a targeted watermist spray. The targeted system uses wall-mounted spray heads with a rotatable head spray head assembly and uses a pyrometer mounted on the rotatable head to determine the angular location of the fire.

In its initial version, Automist Smartscan is expensive for a large home if fire suppression is required in all rooms, as it is limited to one spray head per pump. In addition, care is required not to place Automist Smartscan in close view of known heat sources, as this creates the risk of mis-targeting in a fire.

SUMMARY

The present invention seeks to ameliorate one or more of these problems.

According to a first aspect of the present invention there is provided a wall-mountable spray head unit.

The wall-mountable spray head unit may comprise a pivot base including a first path for fire-suppressant material. The wall-mountable spray head unit may comprise a spray head assembly mounted on the pivot base configured so as to be rotatable about an axis between a first position (or "closed" position) and a range of second positions (or "open" positions), the spray head assembly including a second path for fire-suppressant material. The spray head assembly and pivot shaft may be arranged such that, in the first position, the first and second paths are not in fluid communication and, in the range of second positions, the first and second paths are in fluid communication.

Thus, the pivot base and spray head assembly can provide a pivot joint which can serve as a valve. If there is more than one spray head unit in a fire suppression system, individual spray heads can be selectively activated and deploy fire suppressant material without the need for an additional valve.

The pivot base may include a shaft comprising a central channel and an outer surface wherein the first path include at least one radial channel between the central channel and the outer surface. The spray head may comprise a nozzle and a hole having an inner surface wherein the second path includes a channel between the nozzle and the inner surface.

There may be two or more radial channels angularly spaced.

The spray head unit may include an inclined seal (such as an 'O'-ring) arranged to divide a space between the outer surface of the shaft and the inner surface of the spray head into first and second separate spaces (or "wet" and "dry" spaces).

The spray head unit may include a further seal.

According to a second aspect of the present invention there is provided a fire suppression system comprising at least one wall-mounted spray head unit, which is wall mounted, at least one pressure generator for supplying fire suppressant material under pressure to the at least one wall-mountable spray head and at least one activation device which, in response to an activation signal, causes fire suppressant material to spray out from the spray head(s) of the at least one wall-mountable spray head unit.

According to a third aspect of the present invention there is provided a fire suppression system comprising at least two wall-mounted spray head units, which are wall mounted, at least one pressure generator for supplying fire suppressant material under pressure to the at least one wall-mountable spray head and at least one activation device which, in response to an activation signal, causes fire suppressant material to spray out from the spray head(s) of the at least one wall-mountable spray head unit.

According to a fourth aspect of the present invention there is provided a method of operating a spray head unit. The spray head unit may comprise a rotatable spray head assembly which comprises a spray manifold rotatable about a first axis and a spray nozzle supported by the spray manifold and orientated to deliver fire-suppressant material radially in a plane defined by the first axis and a second axis which is perpendicular to the first axis and at least one thermal sensor configured to sense in the plane. The method may comprise, in response to receiving a trigger, performing a scan for a fire, transmitting scan data to at least one other spray head unit, receiving scan data from the at least one other spray head unit and determining which of the spray head units is best placed to tackle the fire and, in response to determining that the spray head is best placed tackle the fire, to rotate the spray head assembly to an angle for tackling the file.

The method may further comprise, in response to receiving signals from the at least one other spray head unit, that the spray head units are closed, to transmit a signal to request water to be delivered.

The method may comprise, in response to determining that another spray head is best placed tackle the fire, to rotate the spray head assembly to a closed position.

The method may further comprise, in response to moving to the closed position, to transmit a message to the spray head that is best placed tackle the fire that the spray head assembly to a closed position.

According to a fifth aspect of the present invention there is provided a method of operating a spray head unit. The spray head unit may comprise a rotatable spray head assembly which comprises a spray manifold rotatable about a first axis and a spray nozzle supported by the spray manifold and orientated to deliver fire-suppressant material radially in a plane defined by the first axis and a second axis which is perpendicular to the first axis and at least one thermal sensor configured to sense in the plane. The method may comprise recording known heat sources and, in response to performing a scan for a fire, to take into account the known heat sources.

According to a sixth aspect of the present invention there is provided a method of testing comprising closing or keeping closed a wall-mountable spray head, operating a pressure generator for a period of time and measuring pressure in a feed line to the spray head or measuring an electrical characteristic of the pressure generator.

The method may comprise, if there is more than one spray head, closing or keeping closed the more than one spray head. The period of time may be at least 100 ins. The period of time may be no more than 10 seconds.

According to a seventh aspect of the present invention there is provided a method of operating a rotatable spray head or a system comprising at least two rotatable spray heads, the method comprising determining if a temperature measured by a temperature sensor (e.g. pyrometer) of the spray head or at least one of the at least two one spray heads at at least one azimuthal angle exceeds a threshold and, in response to determining that temperature exceeds the threshold, triggering operation of a spray head.

This can help minimize or avoid false activation.

According to an eighth aspect of the present invention there is provided a wall-mountable spray head unit comprising a wipe station arranged to wipe deposited liquid on the temperature sensor (e.g. pyrometer).

Thus, the temperature sensor can be cleaned after a period of operation, thereby allowing more than one operation in turn.

According to a ninth aspect of the present invention there is provided a method of operating a rotatable spray head or a system comprising at least two rotatable spray heads, the method causing a pressure generator to pause and scanning so as to identify or confirm a fire, to choose a spray head to tackle the fire, or any combination thereof.

The method may comprise triggering pausing of the pressure generator in response to sensor data, in response to an elapsed time, or in response to both sensor data and elapsed time.

According to a tenth aspect of the present invention there is provided a method of operating a spray head unit, the method comprising detecting obstruction of the spray head unit.

Detecting obstruction of the spray head unit may comprise using light, using ultrasound, or using both light and ultrasound.

According to an eleventh aspect of the present invention there is provided a wall-mountable spray head unit comprising a display, user input devices, or both a display and user input devices.

This can help discourage obstruction.

According to a twelfth aspect of the present invention there is provided a fire suppression system comprising at least one wall-mountable spray head, at least one pump and at least one fire detector in wired or wireless communication with each other. The system can be configured to identify fault conditions, such as detectors with low battery or missing/failed units, and signalled to a remote device.

According to an aspect of the present invention there is provided a wall-mountable spray head unit. The spray head unit comprises a rotatable spray head assembly which comprises a spray manifold rotatable about a first axis, a spray nozzle supported by the spray manifold and orientated to deliver fire-suppressant material (such as water or a water-based material) radially in a plane defined by the first axis and a second axis which is perpendicular to the first axis. The spray head unit further comprises at least one thermal sensor configured to sense in the plane.

The spray head unit can be easily installed in a home and used in lieu of a fire sprinkler. The spray head unit can provide comparable performance to sprinkler.

The rotatable spray head assembly may comprise one or more thermal sensors supported by the spray manifold aligned with the plane. Thus, the thermal sensor(s) move with the nozzle.

The thermal sensor may take the form of a wide-angle thermal camera or row of thermal sensors and has a sufficiently wide range of view. A controller may look at pixels corresponding to a direction in which the nozzle is aimed.

Thus, the thermal camera or row of thermal sensors may allow the unit to perform a virtual scan. The camera or row of discrete thermal sensors may be fixed, i.e. not move with the spray manifold.

The spray head can be used to deploy a liquid, such as water or a mixture of water and an additive (which may create a foam), or a gas, such as carbon dioxide.

The first axis may be a substantially vertical axis and the plane may be a substantially vertical plane. The second axis may lie substantially in a horizontal plane.

The spray manifold may be only rotatable about the first axis. This can help simplify operation of the spray head unit and, thus, reduce complexity and cost of the unit.

The spray manifold may be rotatable about another axis.

The spray head unit may further comprise an inlet port in fluid communication with the nozzle. The inlet port is preferably offset in a direction into the wall with respect to the first axis. This can allow a supply hose or pipe to be recessed in the wall while allowing the center of rotation of the spray manifold to be further forward. The inlet port may be co-axial with the first axis.

The, or each thermal sensor, may comprise an infrared thermometer. The, or each thermal sensor, may comprise an infrared camera. The, or each thermal sensor, may comprise a sensor which detects flames rather than directly detecting heat.

The spray manifold may include a face (which may be flat or curved) and the spray head and, if disposed in the spray manifold, the at least one thermal sensor may be set in the face.

The spray nozzle and the thermal sensor may be offset in a direction parallel to the first axis. For example, the nozzle may lie just above the thermal sensor or just above the middle of a row of sensors.

The spray head unit may further comprise an actuator configured to cause rotation of the spray manifold about the first axis. The actuator may be a servo motor.

The spray head unit may comprise two or more nozzles.

The spray head unit may comprise an enclosure having an aperture and the rotatable spray head assembly may be housed or mainly housed in the enclosure. The enclosure may comprise a first and second end plates and tubing interposed between the first and second end plates. A front endplate may comprise the aperture. The spray head unit may further comprise an additional face plate. The enclosure may comprise a mounting box (for example, an electrical mounting box) and a faceplate.

The rotatable spray head assembly may be arranged such that, in a parked position, the nozzle and thermometer are not visible through the aperture (when observed from outside the assembly). The rotatable spray head assembly may be arranged such that, in an operating position, the nozzle and thermometer are visible through the aperture or the nozzle and thermometer protrude through the aperture.

The rotatable spray head assembly may comprise a gate valve and may be arranged, such that, in a parked position, the gate valve is closed.

The spray head unit may further comprise a control unit operatively connected to the at least one thermal sensor and configured to control rotation of the rotatable spray head assembly. The control unit may comprise a microcontroller.

The spray head may be configured, in use, to sweep the rotatable spray head assembly through an angular range around the first axis of at least 120°. The spray head may be configured, in use, to sweep the rotatable spray head assembly through a first angular range for locating a fire and through a second, smaller or larger angular range for deploying the fire-suppressant material.

The spray head may be configured to deliver the mist of fire-suppressant material in arc in the plane (i.e. the vertical plane) of at least $2\times\alpha°$. $\alpha$ may be at least 25°. $\alpha$ may be no more than 60°, 55° or 40°. Preferably, $\alpha$ is about 32°.

The spray head unit may be configured to deliver a mist of the fire-suppressant material. The fire-suppressant material may be water or a mixture containing water. The spray head unit may be configured to deliver a watermist.

According to an aspect of the present invention there is provided a fire suppression system comprising at least one wall-mountable spray head unit or at least two wall-mountable spray head units, which is (are) wall mounted, at least one pressure generator for supplying fire suppressant material under pressure to the at least one wall-mountable spray head and at least one activation device which, in response to an activation signal, causes fire suppressant material to spray out from the spray head(s) of the at least one wall-mountable spray head unit.

The spray head unit may be mounted in wall-like objects which are not necessarily walls. For example, the spray head unit may be mounted to a pillar, a false wall, or a wall of a set of shelves or other piece of furniture According to an aspect of the present invention there is provided a building automation system including a fire suppression system according to the second aspect of the invention which is remotely controllable.

The building automation system may include at least one camera. The system may be configured to transmit images from the camera to a remote location, such as a server. The system may be configured to receive from a remote location, a signal to selectably activate or deactivate the fire suppression system.

According to an aspect of the present invention there is provided a method of operating a spray head unit.

The method may comprise, in response to a trigger, rotating the spray head assembly about the first axis, monitoring signals from the at least one thermal sensor, processing the signals so as to identify a desired angle of rotation, and causing the spray head assembly to stop rotating at the desired angle of rotation.

Rotating the spray head assembly comprises sweeping the spray head back and/or forth at least once.

The method may comprise starting to deliver the fire-suppressant material after the spray head assembly has stopped rotating at the desired angle of rotation.

The method may be implemented in software or in hardware.

According to an aspect of the present invention there is provided a computer program which, when executed by at least one or more processors, causes the processors to perform the method.

According to an aspect of the present invention there is provided a hardware processor, such as an FPGA, which is configured to perform the method.

According to a seventh aspect of the present invention there is provided a computer readable medium, optionally a non-transitory computer readable medium, which stores or carries the computer program.

BRIEF DESCRIPTION OF THE DRAWINGS

Certain embodiments of the present invention will now be described, by way of example, with reference to the accompanying drawings, in which.

DETAILED DESCRIPTION OF CERTAIN EMBODIMENTS

Introduction

Figure 1:
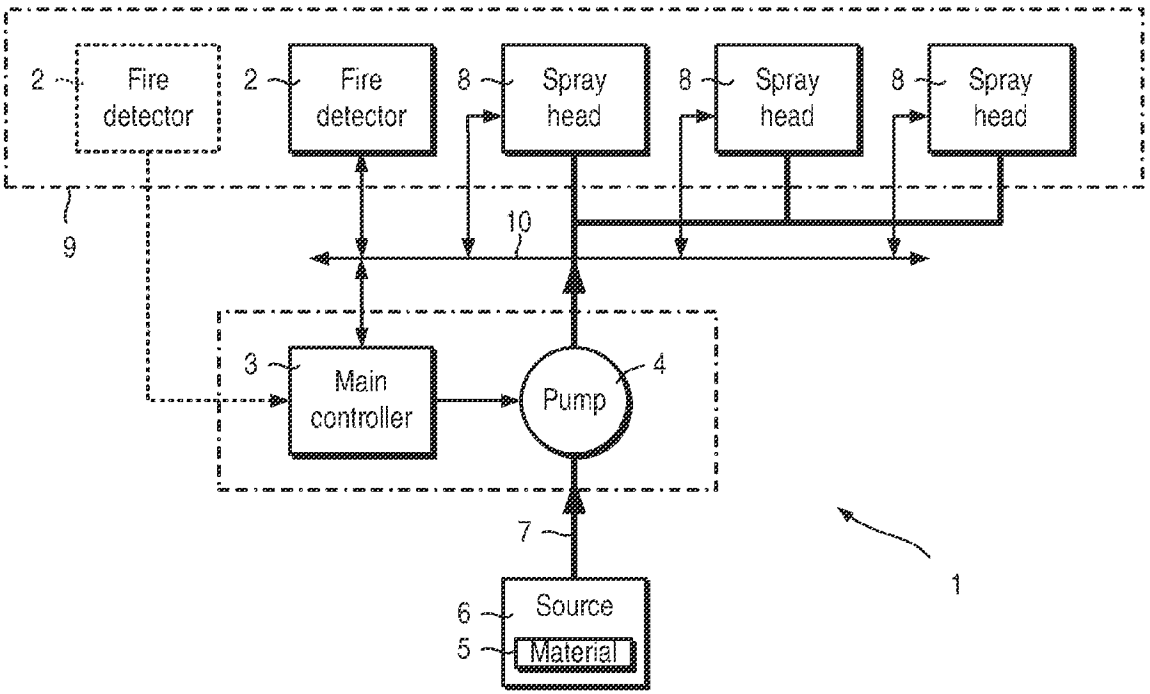
FIG. 1 is a schematic block diagram of a fire suppression system which includes at least two spray heads for spraying fire suppressant material.

Referring to FIG. 1, a fire protection system 1 (which may also be referred to as a "fire suppression system") is shown.

The system 1 includes at least one fire detector 2, a main controller 3, one or more pressure generators 4 (or "pumps") for supplying fire suppressing material 5, in this example water, from a source 6 via piping 7 to at least one rotatable spray head assembly 8 (herein also referred to simply as a "spray head"). The main controller 3 may be omitted or its functions are implemented by the spray heads. As shown in FIG. 1, the fire detector 2 and the spray head(s) 8 may be co-located in one space 9, for example, a room. Two or more of the fire detector 2, main controller 3, and the spray head(s) 8 are connected by a communication network 10, for example, an Ethernet-over-powerline network. The system 1, however, may include dedicated point-to-point communication link(s) (not shown). For example, the fire detector 2 and main controller 3 may be connected by a separate, dedicated wired link.

The general principle of operation of the system is described in WO 2010/058183 A1 which is incorporated herein by reference.

Figure 2:
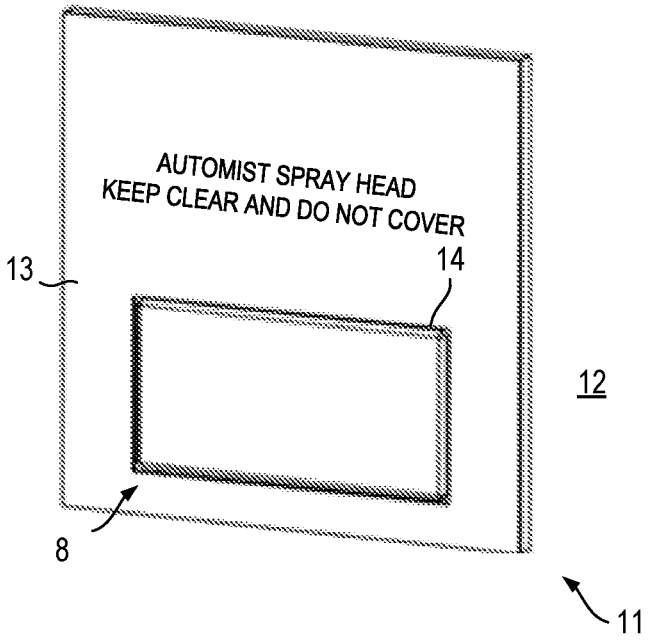
FIG. 2 is a perspective view of a wall and a wall-mounted spray head unit which includes a rotatable spray head assembly in a closed position.
Figure 3:
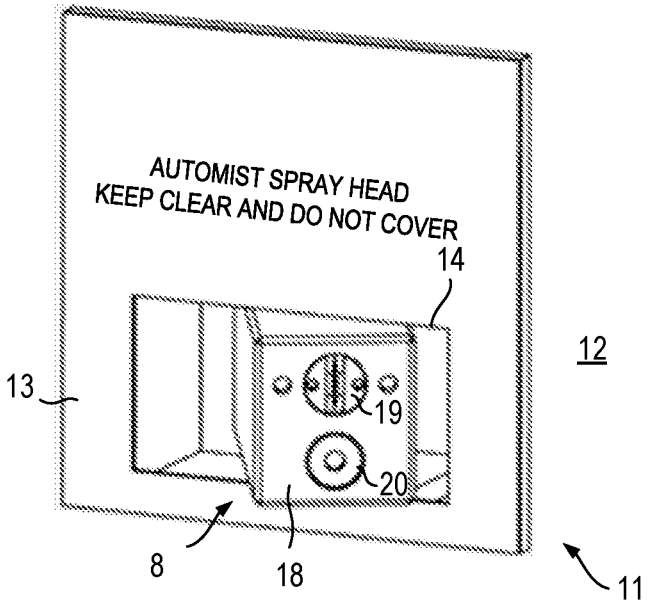
FIG. 3 is a perspective view of a wall and a wall-mounted spray head unit which includes a rotatable spray head assembly in an open position.
Figure 4:
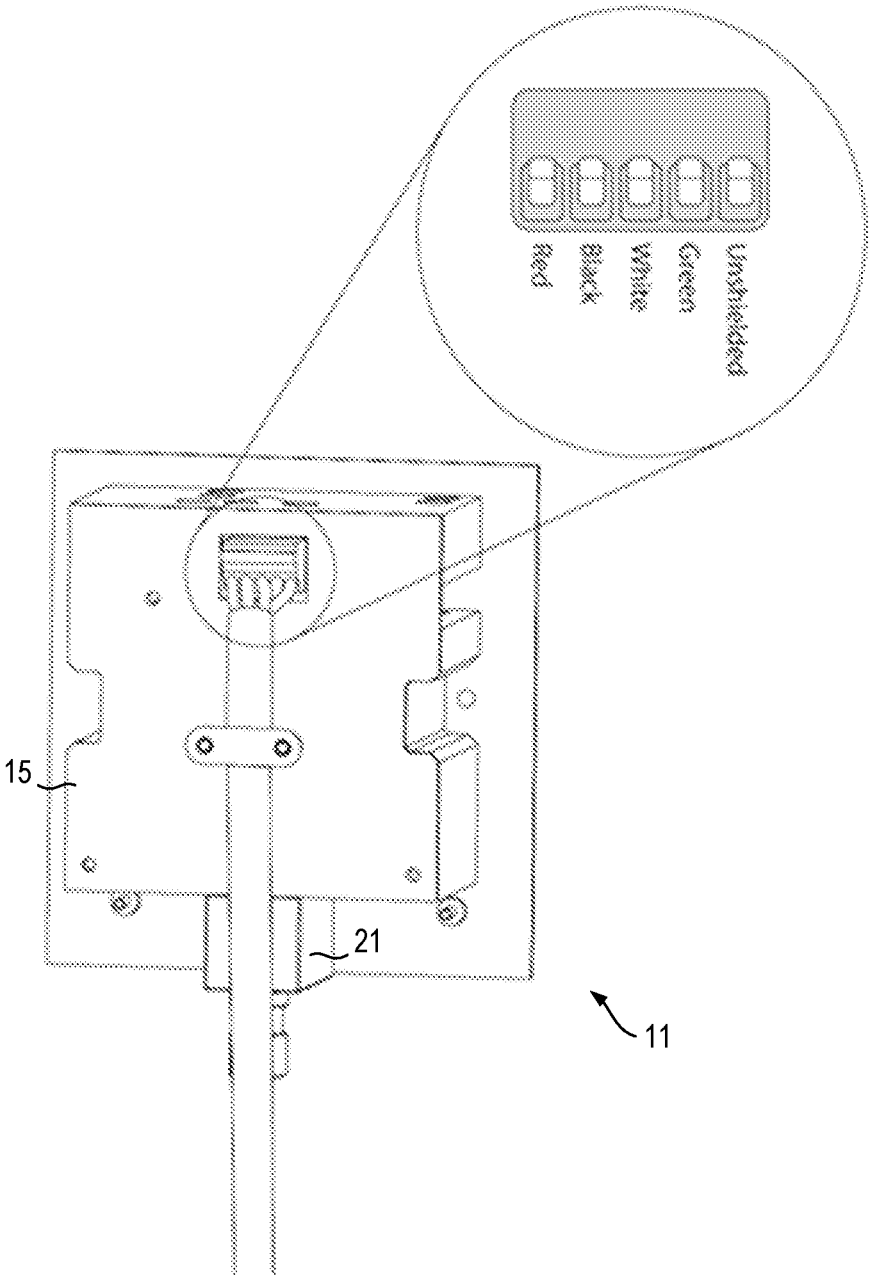
FIG. 4 is a perspective view of a back of a wall-mounted spray head unit.
Figure 5:
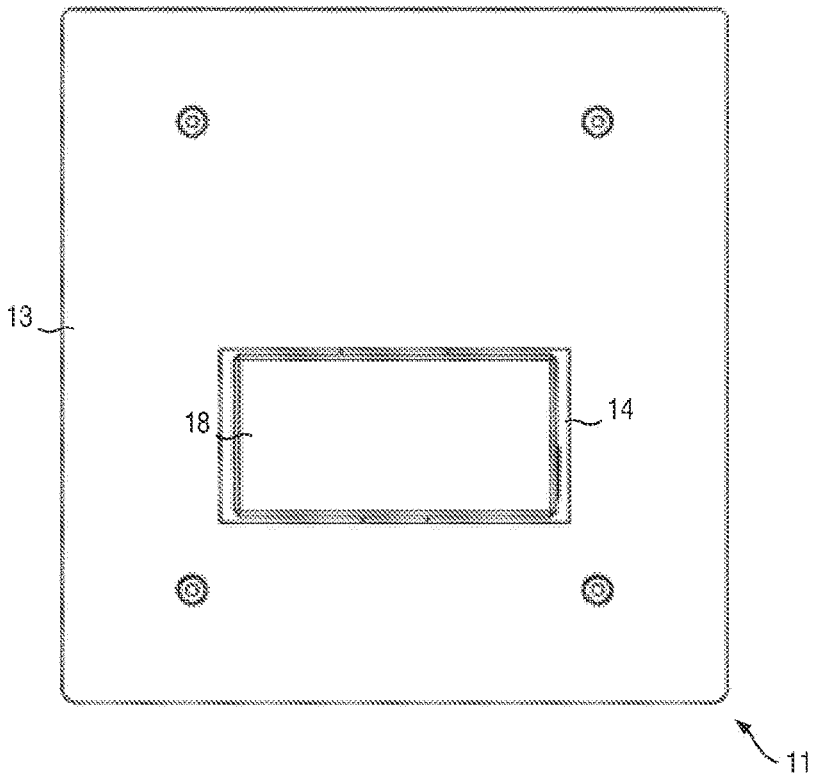
FIG. 5 is a front elevation of a wall-mounted spray head unit.
Figure 6:
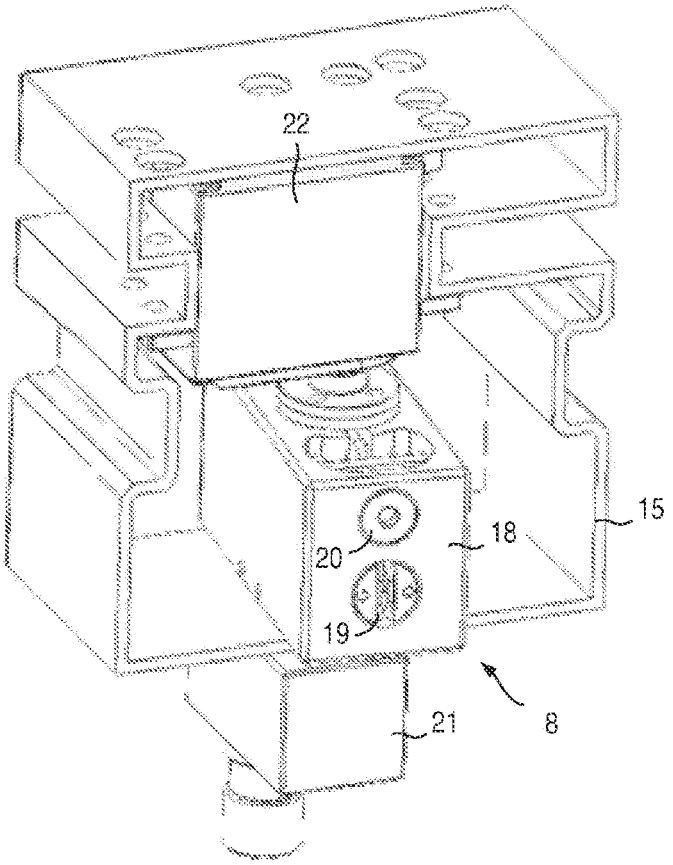
FIG. 6 is a perspective view of a wall-mounted spray head unit without a faceplate.

Referring also to FIGS. 2 and 3, each spray head 8 forms part of a spray head unit 11 which is mounted to a wall 12. When the system 1 is activated, the pressure generator(s) 4 delivers water 5 at high pressure, in this example about 80 bar (8 MPa), and the spray head 8 sprays a fine mist of water (herein referred to as "watermist").

Multiple spray head units 11 co-operate to suppress a fire using targeted jets of watermist. The pressure generator(s) 4 provide the pressure on demand to allow watermist to be created by one or more of the multiple spray heads 8.

The system 1 can help to solve one or more problems, such as, for example, how to adapt a dry-pipe open-nozzle system to work with multiple spray heads 8 attached to a single pressure generator 4 or bank of shared pressure generators 4, how to select which of several candidate spray heads 8 should tackle a fire, how to improve targeting to allow for known heat sources that should not be targeted, or any combination thereof. The system 1 can also help to improve reliability, such as preventing unwanted activations and improving the likelihood of correct operation in a fire.

Wall-Mountable Spray Head Units

The fire suppression system 1 includes multiple wall-mountable spray head units 11 with rotatable spray head assemblies 8.

The fire detector 2 that triggers the system is preferably one or more fixed point heat detectors with a set point between 57° C. and 58° C. The system may alternatively be arranged to be activated by one or more smoke detectors (not shown). This can provide earlier activation and therefore may allow a fire to be suppressed before it grows excessively.

Referring to FIGS. 2 to 6, each spray head unit 11 comprises a faceplate 13 having an aperture 14 and a main enclosure portion 15 (herein also referred to as a "mounting box"). Preferably, the main enclosure portion 15 sits in a recess (not shown) in the wall 12.

Figure 10:
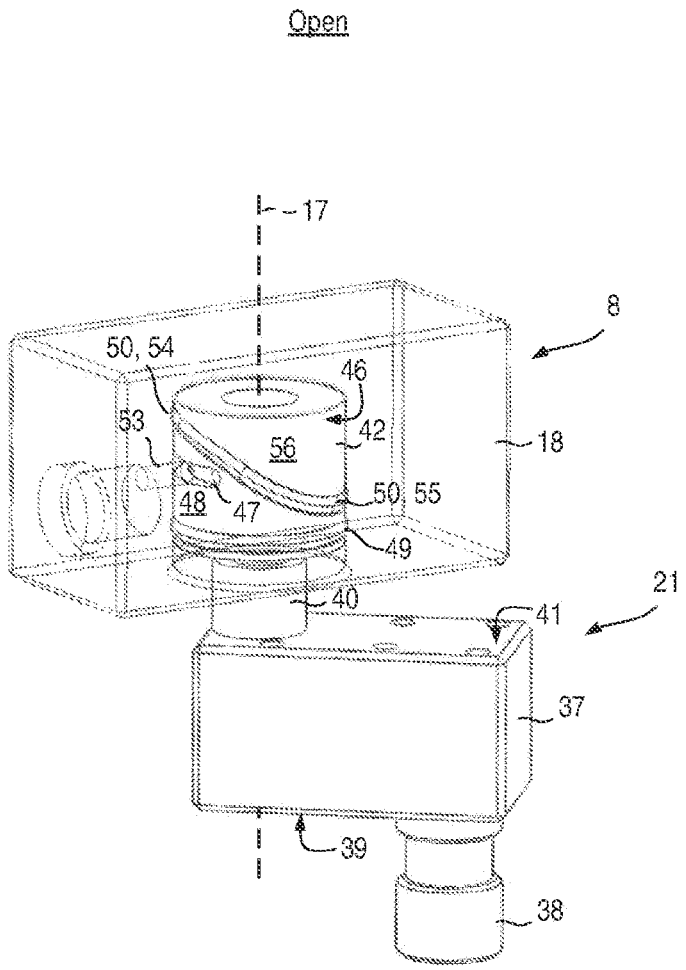
FIG. 10 is a perspective view of spray head in an open position in which fire-suppressant material is delivered.
Figure 11:
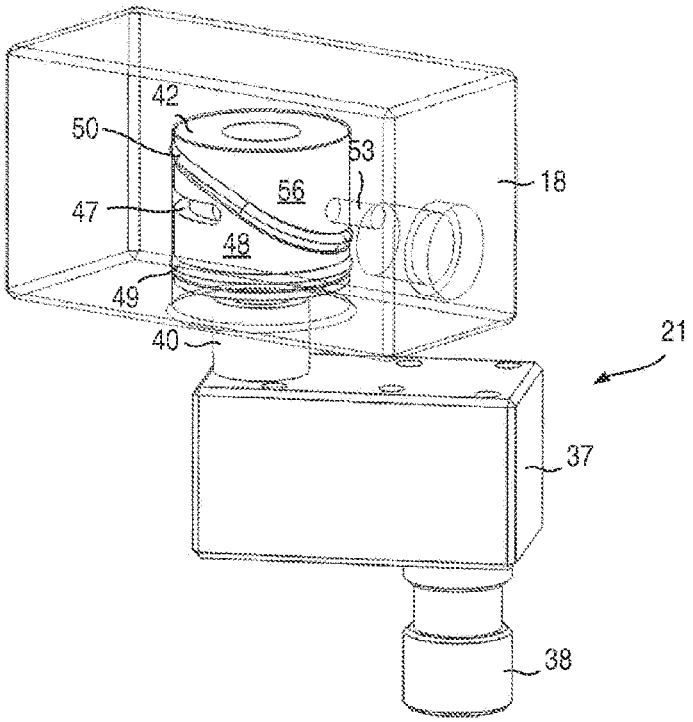
FIG. 11 is a perspective view of spray head in a closed position.
Figure 15:
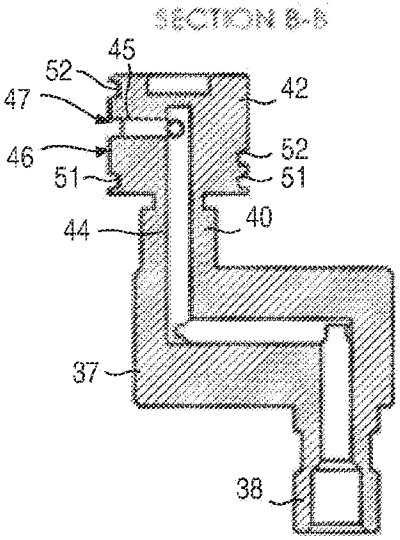
FIG. 15 is a cross-sectional view of the base shown in FIG. 13 taken along the line B-B'.
Figure 13:
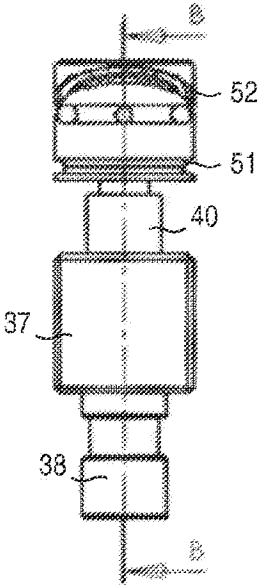
FIG. 13 is an end view of the base shown in FIG. 12.
Figure 12:
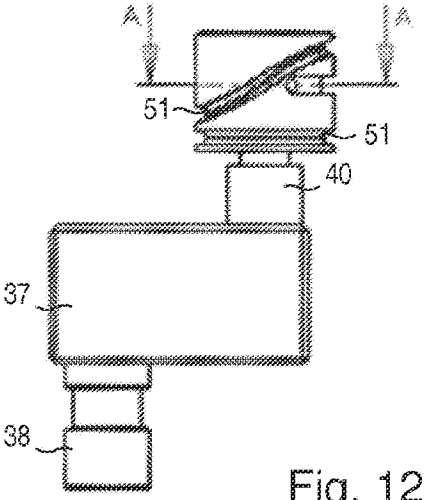
FIG. 12 is a side view of a base on which a rotatable spray head is mounted.
Figure 14:
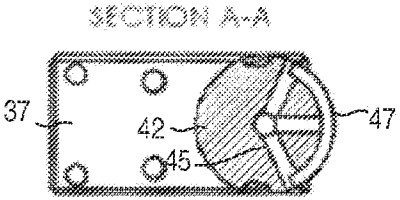
FIG. 14 is a cross-sectional view of the base shown in FIG. 12 taken along the line A-A'.

The spray head unit 11 comprises a rotatable spray head assembly 8 which can turn on one, vertical axis 17 (FIG. 10). The rotatable spray head assembly 8 comprises an elongate box-shaped manifold 18, a spray nozzle 19, a thermal sensor 20 in the form of an infrared pyrometer aligned with the nozzle 19. The rotatable spray head assembly 8 is mounted on a base 21 and is driven by a motor 22.

Figure 7:
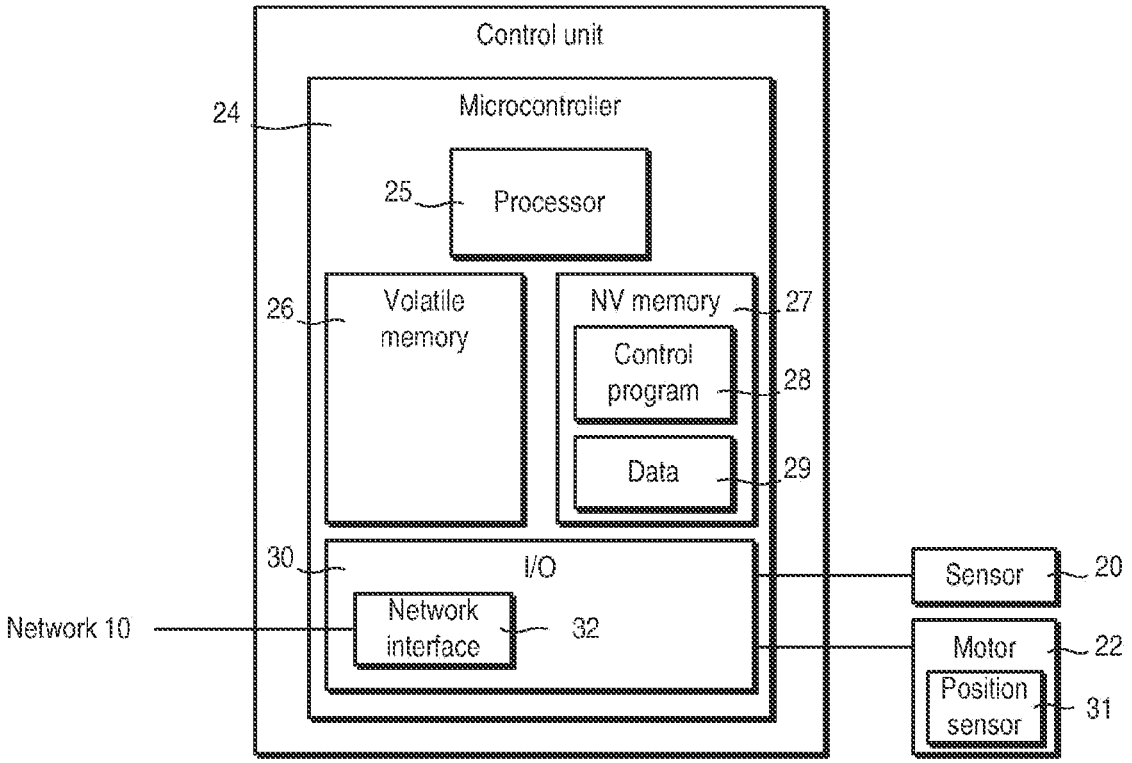
FIG. 7 is a schematic block diagram of a spray head unit control unit.
Figure 8:
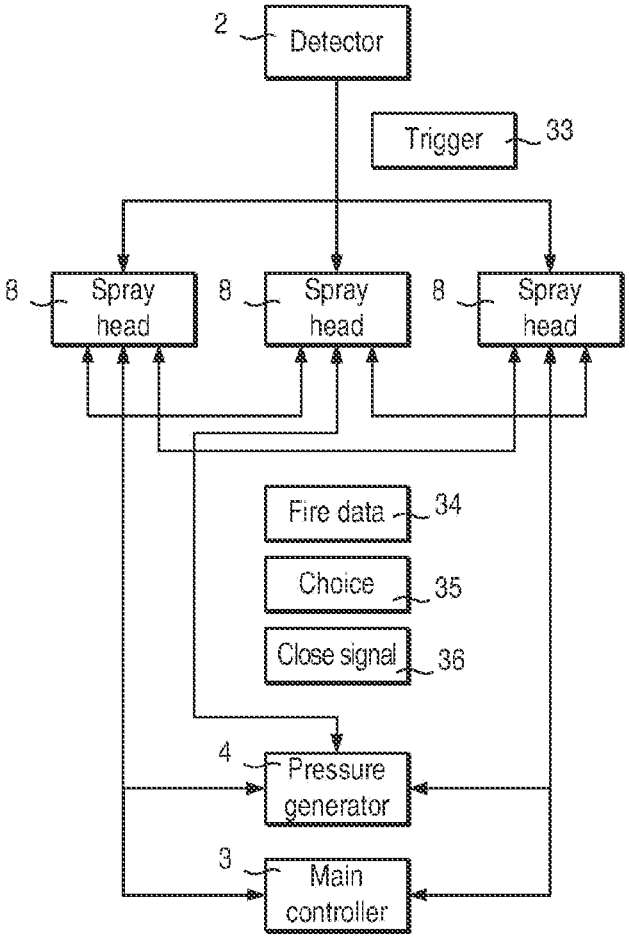
FIG. 8 illustrates signals exchanged between a detector and spray heads.
Figure 9:
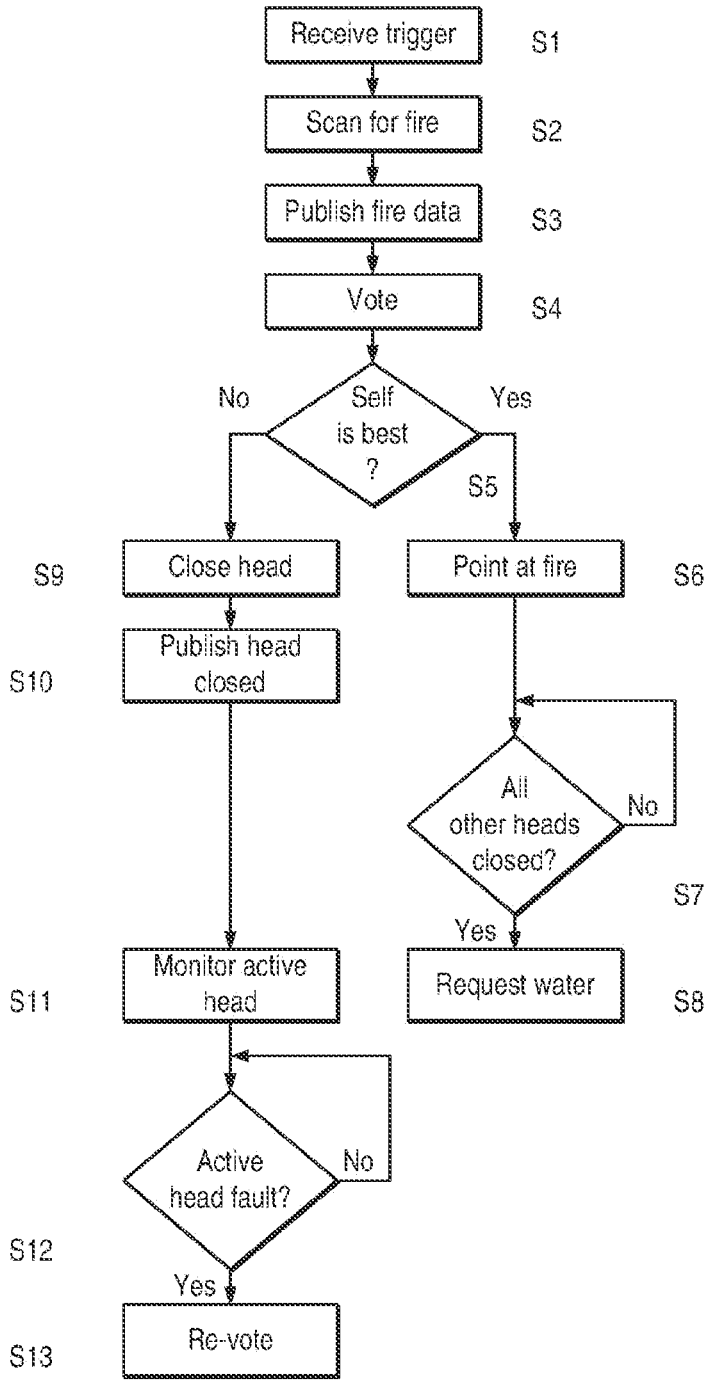
FIG. 9 is a process flow diagram of a method of operating a spray head carried out by each of two or more spray heads.

Referring also to FIG. 7, each spray head unit 11 includes a spray head control unit which includes a spray head controller 24 in the form of a microcontroller having at least one processor 25, volatile 26 and non-volatile memory 27 which stores a control program 28 and data 29 (such as set-point data, calibration data and/or logged data) and an input/output module 30 which is in communication with thermal sensor 20 and actuator 22 which is used to rotate the spray head 8. The motor 22 preferably includes a position sensor 31, i.e. for sensing azimuthal angle of the spray head.

The input/output module 30 includes an interface 32 to the communication network 10. The communications network interface 32 may be a power line signalling interface.

The rotatable head assembly 8 can be swept back and forth under the control of software 28 to afford the head to be pointed at a wide range of locations within a room.

When activated by heat detectors 2, a fire location algorithm (or "fire location routine") provided by the control program 28 may involve a simple series of back-and-forth rotation sweeps to identify the azimuthal angle at which the greatest average temperature is detected. If a smoke detector is used, the fire location algorithm additionally confirms that a fire is actually present. It can detect that the fire is growing by a time series of measurements, if necessary through a delay or additional sweeps.

Targeting Algorithm

The system 1 uses a series of algorithms to control the behavior of the system as a whole and of individual spray heads.

In its simplest form where a single spray head 8 has a dedicated pressure generator 4, the head's targeting algorithm can scan the rotatable spray head assembly back and forth. As soon as a suitable azimuthal "hottest" position can be unambiguously identified due to consistent sensor readings (provided that at least a minimum number of sweeps has been made), this identified position is used, the rotatable spray head assembly 8 fixed at that azimuthal position, and the pressure generator 4 and other ancillary systems activated at that point. If a suitably consistent azimuthal position cannot be identified, the sweeps continue back and forth, up to a maximum number of sweeps, after which the best candidate position will be selected based on the information available.

In a more advanced version of the algorithm, the peak temperature is measured to be at least a critical threshold above the known background temperature in the room before the movement ceases and the pump is activated. For example, the peak temperature may be required to be at least 15° C. above the measured background temperature. The background temperature is measured before the sweep begins, when the pyrometer 20 is pointed inside the spray head. In the event of activation, the stored background temperature may also be updated to match any lower temperatures that are observed within the room (which allows for the possibility that the head is slightly warmer than the room). If such a peak temperature is not measured, the scan continues until a pre-programmed maximum number of sweeps has been reached, after which the system can be configured to activate, return to standby or enter another state.

In another more advanced version of the algorithm, the system can be calibrated for known heat sources. In this case, an installation procedure includes a training process in which typical maximum observed temperatures are measured with respect to azimuthal angle. In this process, known sources of heat, such as radiators or wood burning stoves, are activated and allowed to warm up before the rotatable spray head assembly 8 is taken through a calibration sweep. This training process can optionally be extended to an automated learning process over time, to allow collection of typical temperature variations with respect to azimuthal angle, allowing an installed system to reject incorrect hot targets such as radiators, automatically.

The advanced version algorithm works as follows:

At heat source calibration time, the pyrometer 20 is scanned stepwise across the scene and at, each azimuthal angle β, a measurement of the average temperature across the pyrometer's field of view is taken. Over a series of scans, the average temperature above background is calculated for each azimuthal position (step A1).

Following this series of scans, if no previous heat source calibration has been recorded, the calibration data is saved to non-volatile memory 24 as an array Tcal(β) (step A2). For example, if the average room temperature measurements at each angle vary between 22° C. and 170° C., the array will contain values in the range 0° C. to 148° C.

If previous heat source calibration(s) have been recorded, a new dataset is created consisting of, for each azimuthal position, whichever is the higher temperature of the old and new data points at that angular position (step A3). The result is saved back to non-volatile memory 24, overwriting the previous calibration data.

In the event of an activation, the background temperature Tbackground is first measured (step A4). As described above, this may be reduced if lower temperatures are observed during the subsequent sweeps.

As sweeps continue, seeking the hottest point, a fire is not deemed to be located unless the peak temperature is a critical number of degrees above the background temperature (step A5). However, the critical number of degrees is now not a fixed value, but is determined by the stored maximum temperature above background at each azimuthal angular position. A fire is not deemed to be located unless the temperature at position β exceeds Tmin(β) where:

$$T\min(\beta)=T\text{background}+(1+a)T\text{cal}(\beta)+b \quad (1)$$

In equation (1) above, a and b are constants which preferably take values of approximately 0.1±0.1 and 15° C.±10° C. respectively. The constants a and b allow for the calibrated heat sources to be slightly hotter than they were at calibration time before a fire is deemed to have been found.

In another more advanced version of the algorithm, the algorithm additionally makes the final determination as to whether the system should activate and spray the fire suppressant liquid. Such a version can be used with any detector prone to nuisance activations, such as smoke detectors. After each sensor sweep, the algorithm will identify the best candidate for the azimuthal angle of the fire, and verify that at that azimuthal angle, either the observed temperature exceeds a critical threshold, or that the peak temperature at or around that position is increasing faster than a critical rate threshold. Alternatively, the algorithm may assess the statistics of observed room temperatures across a sensor sweep and may infer the presence of a fire from these, for example observing that even the lowest room temperature on each sweep is rising, or that an average observed temperature across the sweep is rising between sweeps. If the verification is not obtained, the fire suppression system will not activate.

Multiple Head Operation

Most existing fire suppression systems have a specific link between detection and spray or sprinkler head. For example, in traditional sprinklers, a thermal element changes, breaks or deforms to allow water to flow through a co-located valve (permanently). Such configurations are inflexible: detection is intimately linked to actuation. Most existing systems also have limited ability for self-healing redundancy without additional cost, and any redundancy needs to be explicitly designed and built into the system.

Referring to FIG. 1, in the fire suppression system 1 having multiple spray heads 8, a collection of detection devices 2, intelligent rotatable spray heads 8 and one or more pumps 4 can be assembled into a self-healing network. This self-healing fire suppression network can help to provide the best suppression possible given the operational devices available to the system.

Eliminating False Alarms

As hereinbefore described, existing water and watermist suppression systems generally only require a single triggering detector or transducer to activate the system. It is not common or straightforward to configure such systems to require two separate transducers or detectors to trigger in order to permit activation. The lack of "double knock" can in principle lead to unwanted activations.

In current versions of Plumis's Automist, activation comes from a relay input. It is thus possible to connect two trigger devices so they must both activate before the system activates, for example, by connecting two relays in series, each triggered by a separate detector. Such options add cost and, more importantly, have an impact on the aesthetics of the project, with multiple detectors visible on the ceiling.

In the fire suppression system 1, additional techniques can be used to confirm or reject an activation. These techniques can be applied with one or more spray heads 8 within a room and confidence level in an activation or rejection can be increased if multiple heads can confirm the observation.

The spray heads 8 can log background temperature readings continuously and retrieve a record of recent temperatures when called upon to locate a fire. The lack of an increasing background temperature leading up to the activation suggests that the activation may not be genuine and this datum can be factored into the overall algorithmic decision of whether to activate. The data can, for example, be logged every minute (night and day) and a ten-minute set of records examined when scanning begins.

As mentioned earlier, where a smoke detector is used as activation device, the fire location algorithm itself can (whilst scans take place) confirm that a fire is actually present by monitoring for temperature changes in the room, either away from the fire at the coolest point(s), or at the fire location, or by monitoring average temperatures across the sweep range.

Choice of Spray Head to Activate

Referring to FIGS. 1, 7, 8 and 9, in operation, an external trigger detector, normally a heat detector 2, indicates that a fire has been detected in a specific area covered by that detector by transmitting a trigger 33 (step S1). When this happens all spray heads 8 that are associated with that detector 2 (normally this means spray heads 8 and detectors 2 in the same room) scan the room using the fire detection algorithm to determine if the on-board pyrometers 20 can sense a fire (step S2). All selected heads 8 publish (i.e. transmit to the other heads via communications network 10) their findings, i.e. fire data 34, to all other selected heads (step S3). All selected heads then independently compare the data of all heads including their own and use a voting algorithm to decide on what head has the best "shot" at the fire (step S4). All heads will then publish their choice 35 as to the head that is best positioned to tackle the fire. On receiving this published data 35 from other heads 8, each head 8 compares it with its own decision on a majority vote (step S5). If the head 8 is chosen by the majority vote, then it points at the fire (step S6) and waits for other heads to confirm, using a close signal 36, they have closed (step S7) before requesting that the pump run (step S8).

Spray heads 8 that are not selected then park, close their associated valves (step S9) and notify the chosen head (step S10), and monitor the operation of the system (step S11) through suitable performance proxies, such as temperature or pressure measurements, to ensure the pump is turned on by the selected head. If the pump is not engaged by the selected head within a safety time, the selected head will be assumed to be faulty (step S12) and the scan and vote will take place again with that head excluded (step S13).

The voting algorithm can use one of a number of methods, for example "single transferable vote" or Condorcet methods. The voting scheme includes methods to avoid stalemates (or "ties"), such as casting votes. In some implementations, different devices may receive differing numbers of votes.

In implementations where all spray heads 8 are identical and correctly functioning, the vote is unanimous, except in the event of a tie, where a pseudo random or tiebreaking element may be introduced at this stage. However, if different software or hardware versions are present in the various devices around the network, different devices may vote differently. Nevertheless, the voting process is adapted to ensure that the network and its decisions remain robust. In general, the system may be configured to employ other elements of the *Byzantine* Fault Tolerance approach in order to improve its reliability.

Multi-Head Positional Triangulation Based on Room Layout

With a single spray head 8 it is difficult to distinguish a near, small fire from a far, large fire. Scan datasets from multiple heads 8 can be combined to reduce ambiguity in what is observed.

If multiple spray heads 8 are fitted within the same room, the system 1 allows creation of a two-dimensional room map that includes realistic dimensions, obstructions and potentially known heat sources, which can be encoded and uploaded to one or more information storage modules, such as memory 26 or memory 27 in microcontroller 24.

In one version, an algorithm evaluates hypotheses regarding the likely location of a large fire within this room map. A single large fire is hypothesized in every single location in the room in turn (working on a grid) and that possible fire location is scored against the observations of the multiple heads, based on each head's distance and azimuthal angle to the proposed fire. The best scoring candidate fire location (i.e. most consistent with observations) is likely to be the true location and a head can be selected for activation that is both close and in view of the fire.

For example, if a fire occurs close to a first spray head, but directly in between the first head and a known heat source (such as a wood burning stove), the first spray head may not be able to confirm the fire's presence. A second spray head, which is further away and so should not be activated, can be used to confirm the presence of a fire in between the first spray head and the heat source, influencing the choice of which spray head to activate.

Depending on the quality of data fit obtained using a single fire model and the processing power available, two-fire combinations, three-fire combinations and so on can also be evaluated, seeking an improved fit.

This modelling process may be extended further. For example, numerical optimization methods, such as simulated annealing and maximum entropy techniques, may be used to populate the room map with a likely fire intensity value for every pixel in the map.

With a suitably flexible interface to a connected alarm system, the activation (or not) of individual heat or temperature detectors within different parts of the room can also be used to inform the decision about which head or heads to activate.

Flow Control Valve in Head

The rotatable spray head 8 preferably includes a flow control valve which closes when the head is parked but allows flow through the nozzle in other positions.

Referring to FIGS. 10 to 15, during a fire, fluid (e.g. water) is pumped through the high-pressure line into the pivot base 21 of the spray head assembly 11. This happens for all spray heads 8 at once.

Each spray head 8 has a pivot base 21 which includes a lower, box-like bed 37, an inlet port 38 depending from an underside 39 of the bed 37, a short tubular section 40 upstanding from a topside 41 of the bed 37. The inlet port 38 and tubular section 40 extend from different ends of the bed 37. The pivot base 21 includes a fixed, short cylindrical stub axle 42 extending upwardly from the tubular section 40 and which is set within the rotatable manifold 18 that forms the spray head.

A vertical channel 44 extends upwardly through the tubular section 40 and a lower portion of the stub axle 42 along the central axis 17. In the cylindrical stub 42, the channel 44 splits into several (preferably three) radial channels 45 which generally lie in a horizontal plane. The vertical and radial channels 44, 45 may be formed by drilling.

The radial channels 45 pass through the stub axle 42 to an outer surface 46 where they meet a circumferential water-fillable groove (or "trench") 47 recessed into the outer surface 46, extending around only part of the circumference of the stub axle 42. A water-fillable/filled space (not shown) around the trench 47 extends into a thin gap formed between the fixed stub axle 42 and the rotatable manifold 18 that surrounds it. The water-fillable/filled space 48 is bounded by a pair of O-rings 49, 50 that sit in respective grooves or channels 51, 52 in the outer surface 46 of the fixed axle 42.

The spray nozzle 19 is fed water into its rear from a short channel 53 (or "port") machined into the block 18 into which it is mounted. The nozzle feed port 53 is aligned vertically with (i.e. lies at the same height as) the trench 47.

With the spray head 8 in any operational position, the nozzle feed port 53 is in fluid communication with the trench 47 and water is fed into the nozzle feed port 53 when the pressure generator 4 (FIG. 1) is running. The trench 47 and its radial channels 45 are arranged so that this occurs at any operational azimuthal position of the spray head.

The stub axle 42 has an axis of symmetry which runs vertically in the installed spray head unit 11. A first O-ring 49 lies in a horizontal plane below the trench 47 and a second, slanted O-ring 50 runs inclined around the surface of the stub axle 42 with one end 54 of the loop above the trench 47 and the other end 55 below the trench 47.

As the spray head 8 rotates around the stub axle 42 into its parked position, the nozzle feed port 53 crosses the inclined O-ring 50. After crossing the O-ring 50, the port 53 opens into a dry space 56 that is separated from the water-fillable/filled space by the inclined O-ring 50. Thus, in the parked position, the nozzle 19 is isolated from the incoming water and the head is sealed.

In standby, the entire assembly 11 may be largely free from water including water-fillable space (and other nominally wet area or spaces). Also, the control program 28 (FIG. 6) ensures that the head 8 is not rotated whilst under pressure.

Referring also to FIG. 1 again, the pressure generator 4 preferably takes the form of a constant-flow pump. Correct system operation requires output pressure to be fixed within a certain range, typically between 7.5 to 10 MPa (75 and 100 bar) and the system 1 is configured so that the correct pressure will be achieved if exactly one spray head is connected to the high pressure line at any one time. This is achieved under software control, either by operating the flow control valves within each spray head as hereinbefore described to ensure that only one valve is open before the pressure generator is operated or by means of a selector valve (not shown) that moves to an appropriate position depending on the head that is chosen to activate.

Providing Power to Multiple Spray Heads

The spray heads 8 can be powered in a variety of ways including (1) powered directly from their own mains power socket, (2) powered via a. c. mains electricity but routed from the pump 4 to allow the power cable to be used for power line carrier data communication between the head(s) and pump, (3) powered via Power-over-Ethernet from the pump with Ethernet used to provide the data channel or (4) powered from a rechargeable cell, battery or supercapacitor (not shown) which is charged in the standby state from a main power source.

If used, a rechargeable power source (not shown) is selected to provide a few minutes (e.g. 2 or 3 minutes) of peak power to the motor 22 (FIG. 7) that rotates the rotatable spray head 8. Use of such a power source allows the spray heads 8 to employ a main power source that could become unreliable in the event of a fire, such as an unprotected domestic electrical circuit. Use of a rechargeable power source also allows many heads to be powered from a limited-power source, such as Power-over-Ethernet, which is capable of providing their average, but not peak power, demands.

Improved Reliability and Integrity

Most claims which are made regarding successful operation of fire alarm and suppression systems tend to focus on their performance and not their reliability. Focus on performance ignores a key feature of such products, namely how much they reduce risk. Risk reduction is greatly in demand by insurers where it can be documented and a true demonstration of risk reduction could lead to valuable premium reductions for property owners and tenants, which in turn makes the product offering this reduction more valuable to property owners.

The system 1 can be provided with one or more additional feature to provide better reliability and integrity than conventional suppression systems. IEC 61508 methods can be used to calculate and document the reduction in risk that can be achieved as a result of installation of the system.

Features which can further improve system reliability and integrity will now be described:

Self-Test and Readiness Monitoring

A commissioning process can include a test to verify that the pump 4 (FIG. 1) is functioning and the output pressure is in the correct range.

Figure 16:
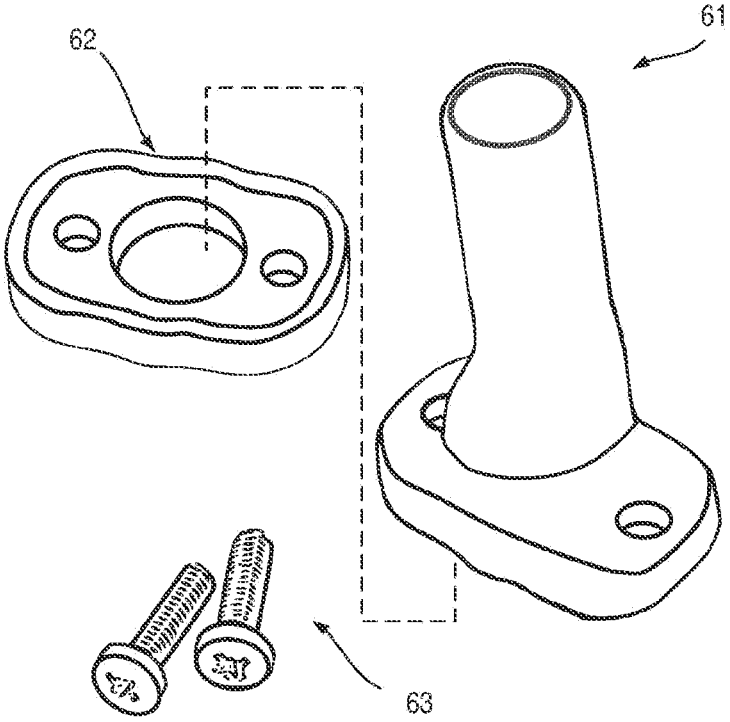
FIG. 16 is a perspective view of parts in a commissioning tool which can be fitted to the spray head so as to collect fire-suppressant material.

Referring to FIG. 16, a funnel-like commissioning tool 61 is connected to the tip of the rotatable spray head 8, via a washer 62 using screws 63, with the purpose of collecting and feeding discharged water into a hose (not shown) and into a receptacle (not shown).

In earlier systems, output pressure was checked automatically by a pressure switch (not shown). If an inadequate pressure was measured at commissioning time, the commissioning process was programmed to fail. Inadequate pressure during a fire led the control algorithm to attempt to stop and restart the pump in an attempt to rectify an assumed pump jam. However, it was found through experience that low cost pressure switches had an unreliable set point which could cause an acceptable pressure to be rejected by a poorly calibrated switch. More complex pressure transducers added too much complexity or cost to the device. In this context, a manually read pressure gauge is an attractive option, but lacks any potential for remote monitoring.

The present system 1 typically employs, as its pressure generator, a pump 4 having a brushed electric motor. The electrical current drawn by the pump 4 has been found to be predominantly real in power factor (i.e. in phase with applied voltage) and proportional to the motor torque. The system can, therefore, be configured to use motor current as a proxy for water pressure when the pump is running. The system 1 can act on an inferred value for pump output pressure in several ways.

The system can be configured to run the pump 4 for a short period as a diagnostic, preferably with the motor energized in one or more pulses of between 0.1 and 10 seconds. This diagnostic can be configured to occur automatically, for example monthly, or upon remote or local instruction. Because the system 1 employs valves that isolate the spray heads, operating the pump 4 does not result in water discharge into the room(s) unless these valves are opened.

By sensing the motor current and its changes over time during the diagnostic, one or more of the following faults can be identified. First, lack of water supply can be detected by a fast rising r.m.s. current as the pump starts up, but the current reaches a plateau at a lower than expected value, indicating motor not loaded fully. Secondly, leaks in output plumbing cause a slow decline in pressure in the output line once the pump is de-energized. Although current within the pump can only be deployed as a proxy for pressure when the pump is energized, if the diagnostic mode includes repeated pulses of pump operation, leaks can be detected by an unexpected drop in current as each pulse first starts after water has leaked away. Thirdly, pump total failure can be detected by virtue of an open circuit. Finally, pump seizure can be detected by virtue of the current being much too low or much too high, or power factor wrong.

At commissioning time, the pump pressure can be automatically monitored. This allows automatic pass and/or fail and potentially eliminates the need for a pressure gauge.

The system may also include a drain (not shown) which allows discharge of output water from the high pressure line into the drain after testing. This can either be achieved with an additional high pressure valve, or by means of the aforementioned manifold which is used in some versions of our invention to route water to one or another head.

The system 1 may incorporate a mode whereby all spray heads are unparked and their valves opened up either sequentially or simultaneously. This mode is used when it is necessary to expel all water from the system.

The system may include a permanent communication channel (not shown) to allow active diagnostics of installed systems to be monitored. These diagnostics can be used to adjust the inspection and service schedule dynamically, for example identifying low battery conditions or damaged equipment, greatly improving reliability.

Redundancy

One self-healing and redundant feature of the system 1 is the ability to recover from leaks or to tolerate more than one spray head 8 activating (which normally would cause a large and undesirable pressure drop) through the use of redundant pumps.

The system 1 may measure the pressure in the high pressure water line during pressure generator operation. If more than one pump is present in the system, sufficient pumps will operate in parallel in order to ensure a correct pressure, with a feedback loop ensuring that this pressure does not vary greatly by means of either motor speed control via voltage, or simple on/off duty cycling with hysteresis to maintain the required pressure. This system concept allows a wide range of configurations (number of pumps versus number of heads) with the possibility of pump overcapacity so that if one fails completely, the other or others can start up or increase their speed or duty cycle to maintain the required pressure. A key result is fault-tolerant operation.

The system 1 may use a microcontroller 24 (FIG. 7) that incorporates a radio module as the universal processing unit in all major components of the system (for example detection, spray heads and pumps). This radio module can be used for communication with wireless detection devices and with Bluetooth® devices for commissioning, and can also be used for external communication to a server (not shown). However, the radio module also creates a redundant communication path between pump and spray heads which improves system reliability.

Documentation of the Safety Integrity Level and Performance Level

The system 1 allows a manufacturer or a third party to document the safety case for the system in a safety concept document and calculate the Safety Integrity Level (SIL) of the system. If required, data on the Performance Level (PL) can also be calculated, which is similar to SIL but also includes the effectiveness of diagnostics. Such techniques provide a direct calculation of the risk reduction for any installed system.

Obstruction Detection

Ceiling-based fire suppression systems can offer an advantage that water heads provide generally unobstructed coverage of the protected room(s) due to their high and central position. Despite some limitations, for example with fires in bunk beds or under tables, ceiling-based systems remain relatively immune to obstruction. Ceiling-based systems, however, have several disadvantages. Installation is usually disruptive in retrofit situations due to the requirement to break, remove or alter ceilings; and the final result may include either lower ceilings or exposed sprinkler heads with poor aesthetics. Concealed sprinkler heads are available with an improved visual appearance, however these may all too easily be completely disabled by papering or painting the ceiling, with no means for the suppression system to detect or signal that it will be ineffective.

Figure 17:
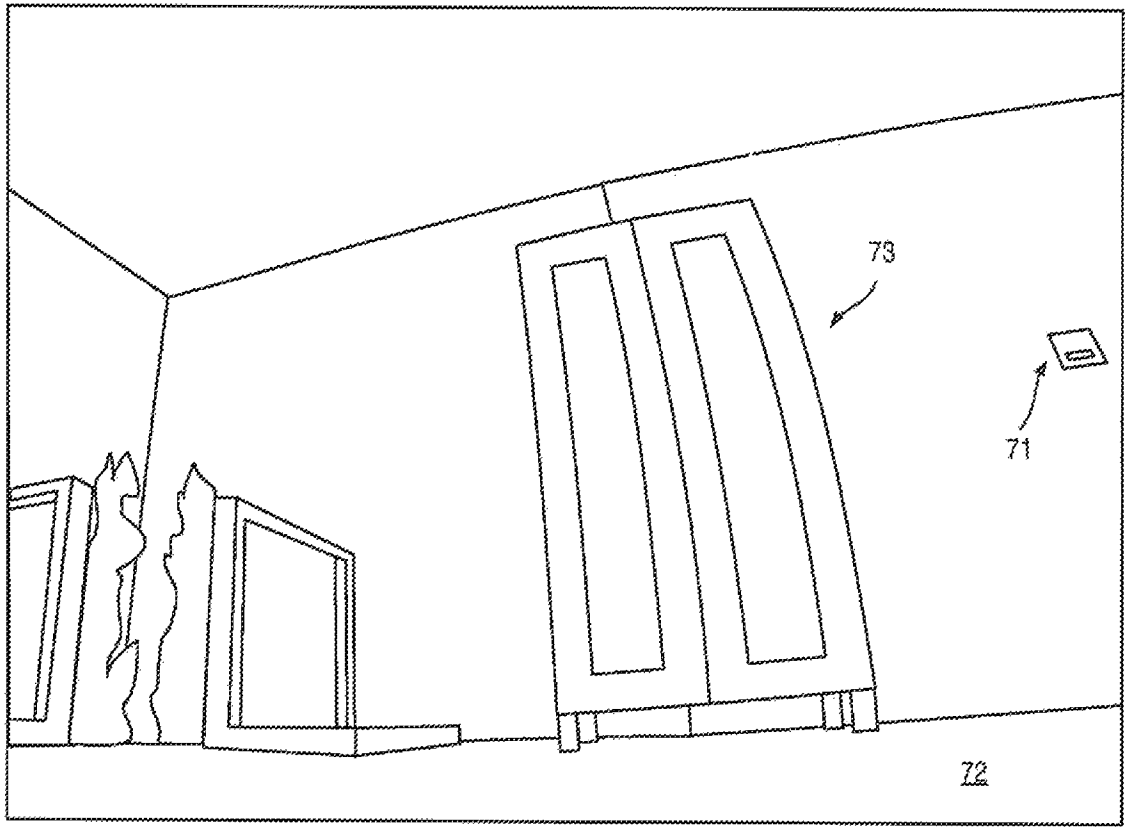
FIG. 17 is a first perspective of a room.
Figure 18:
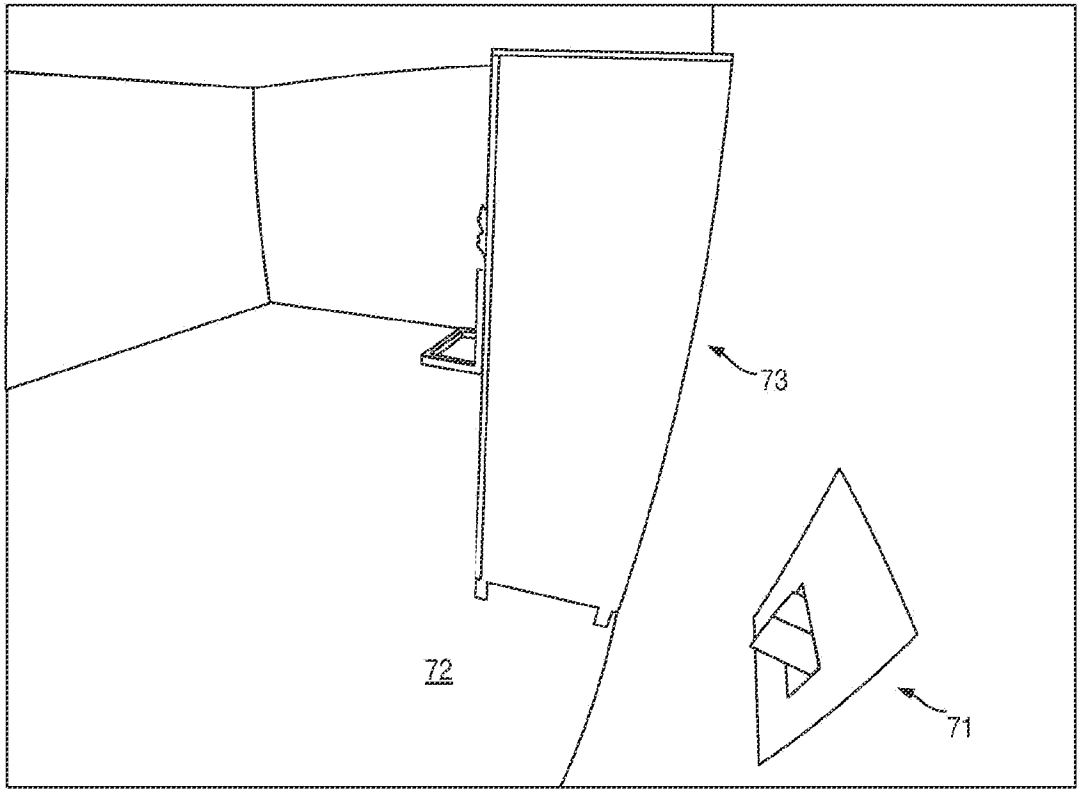
FIG. 18 is a second perspective view of the room shown in FIG. 17.

Referring to FIGS. 17 and 18, wall-mounted watermist fire suppression spray heads 71 may be mounted between 1.2 m and 1.5 m above the level of a finished floor 72. One potential problem with this type of device is that it can be vulnerable to obstruction by tall furniture 73, such as bookcases, placed either in front of or directly beside the spray head, casting a "mist shadow" which impairs fire suppression in part of the room. Residents may not be aware of the risk posed by the obstruction.

The multi-head fire suppression system 1 herein described includes obstruction detection features that allow residents, installers, maintenance companies and other third parties to be notified when a spray head has been obstructed in a way that is likely to compromise its function. In addition, these features may be used as part of a targeting calculation when the rotatable spray head scans, seeking the fire location.

Each rotatable spray head 8 may include a narrow-beam ultrasound range sensor (not shown) whose beam is approximately aligned with the spray nozzle 19 (FIG. 3) and pyrometer 20 (FIG. 3). Such sensors can sense obstructions at a range of up to several meters, which is sufficient to identify most important obstructions when the head scans.

An obstruction sensor (not shown), aligned with the spray nozzle 19 (FIG. 3) and pyrometer 20 (FIG. 3), may take the form of an LED and light transducer pair (not shown), operating preferably in the infrared spectrum, and using lenses to ensure that the ranging beam is narrow. The sensor can use a time of flight measurement. Alternatively, the sensor may simply measure the returned light from diffuse reflection from an LED or other light source, preferably using a flashing source to allow background brightness to be subtracted. Presence of a diffuse reflection indicates a nearby obstruction.

In either case, the sensor's field of view is preferably comparable to the angular step size of the spray head's sweep (typically 3 to 8 degrees) in order to ensure that any suitable obstruction can be identified as the head sweeps across, and in order to maximize the detection signal to noise ratio for obstructions which occupy a relatively narrow azimuthal range.

The spray head may include both optical and ultrasound obstruction sensor modules, to allow for a wider range of obstruction types (for example certain surfaces absorb ultrasound, while low-albedo surfaces do not emit strong light/IR reflections).

The sensor is used in the following ways:

- at initial commissioning or maintenance time, where the head or its connected systems will report obstructions to the service engineer,
- during or following a periodic "inspection sweep" after installation, whereby the head is scanned back and forth when no fire is present, in order to search for obstructions (and optionally perform other functions such as known heat source calibration)
- during a fire, to assist with targeting and head selection. As the head is swept across the scene, seeking the hottest angular position in its field of view, the head also determines whether each position is obstructed. The presence of a higher temperature that is angle-adjacent to a detected obstruction at a lower temperature is likely to indicate an obstructed view of the fire. This allows the invention's embedded software system to de-prioritize the use of the head that has the obstructed view in favor of another head whose view is not obstructed. In the event that the obstructed head remains the chosen head to activate, its spray angle may then be adjusted to spray just past the obstruction.

Obstructions may be detected by light/infrared sources and transducers as hereinbefore described, but mounted on or around the non-moving faceplate of the spray head. This allows obstructions to be detected even when the spray head is parked. Such obstruction sensors require a much wider field of view, close to 180 degrees, which is achieved using a suitable lens arrangement.

The main infrared pyrometer device 20 (FIG. 3) used for fire location may contain a pyrometer array. For example, the array may take the form of an Excelitas TPiA 4.4T 4146 L3.9 small Infrared Array Sensor offering 4×4 pixels. Such pyrometer arrays can be chosen to have a roughly 32° horizontal field of view whilst individual pixels correspond to roughly 8 degrees. Such arrays allow edge detection within any one "view" of the fire scene during the targeting process: where two adjacent pixels report dramatically different temperatures, this can be interpreted as a possible sharp-edged obstruction such as a poorly placed bookcase. The embedded software can use such data to adjust its assessment of whether a fire has in fact been located and whether the obstructed head has the best view of the fire.

The result of these features is that the suppression system 1 can cope better with objects being inadvertently placed to obstruct the spray head, warns relevant parties that the obstruction has taken place, and functions better if the obstruction remains present when a fire occurs.

Fire Monitoring and Live Aim Adjustment

One advantage of an electronic fire suppression system with an adjustable aiming system, such as the rotatable spray head assembly herein described, is that watermist can be targeted very directly into the fire, greatly improving performance over untargeted systems. A common question asked of such targeted systems is, "Can they adapt to a fire which moves or to multiple fires?" Such adaptations pose challenges. In earlier spray head assembly, splashing water from the spray nozzle or mist droplets circulating in the general environment can land on the IR pyrometer. Once landed, droplets may act as lenses, changing the effective field of view, or may act as an opaque coating, blocking the sensor. This reduced the opportunity to follow the effectiveness of the suppression and eliminated the possibility of live re-targeting of the spray based on performance or based on a sweep of the head after spraying has occurred.

The system 1 may be adapted to address these issues.

Firstly, a smooth front plate, suitably transparent to infrared, is fitted to the outer face of the pyrometer assembly. The plate is mounted to be flush with or slightly proud of the rotating spray head's face in which the pyrometer and nozzle are mounted. This allows the infrared pyrometer module to be wiped dry by a wipe station installed inside the head assembly. A wipe station (not shown) consists preferably of a wiper blade which preferably is composed of a synthetic rubber, and an absorbent pad. The wipe station is designed such that the smooth front plate is wiped dry by an excursion from the parked position out and back to the parked position, in one or both directions of travel. The blade serves to scrape water from the plate, while the absorbent pad serves to assist with removal of fine droplets, acts as a small reservoir for the collected water, and wicks the moisture away into parts of the pad that do not contact the plate. The pad may also serve to collect drips from the wiper blades. The water is thus wiped from the smooth front plate, ultimately into the body of the pad where it can gradually evaporate over time. The wipe station can optionally also be designed to collect water from other parts of the moving head where these might permit dripping onto the pyrometer's front plate.

This arrangement allows the invention to tackle a fire for a given period, and then based either on time, on readings from one or more temperature sensors within the room (for example heat detectors), or on other sensors, turn off the pressure generator (i.e. pump), park and unpark the spray head via the wipe station, and then re-review the location(s) of the fire in the room using the newly wiped pyrometer sensor. For example the system 1 may be configured to operate for five minutes, go through the wipe and re-aim procedure, and reactivate if a fire is still indicated by either room sensors or the pyrometer. Alternatively, the system 1 may be programmed to try re-aiming if the temperature has not reduced significantly after five minutes. Re-aiming may include allowing another head to activate in lieu of the first head that activated. It should be understood that for sensors with a suitably proud or flush front lens surface, the wipe station can be configured to wipe the sensor directly rather than a transparent plate.

If a pyrometer array is used (for example the Excelitas TPiA 4.4T 4146 L3.9 small Infrared Array Sensor offering 4×4 pixels), an infrared lens can optionally be mounted in front of or within the sensor module to distort the view of the sensor so that some pixels (e.g. a "top row" of the sensor) are imaging somewhat upwards towards the ceiling, while other pixels receive infrared illumination originating more horizontally across the room from potential fires. Such a configuration allows some of the pixels to be used to infer generally falling or rising temperatures in the upper reaches of the room while others are used as discussed above to seek the fire and identify obstructions. This lens configuration also allows a wider vertical field of view than such sensors offer "out of the box". Suitable lens types include traditional lenses produced from chalcogenide glasses such as GASIR, and Fresnel lenses.

It will be appreciated that the targeting improvements can apply even in a system with only one spray head.

Other Features

Figure 19:
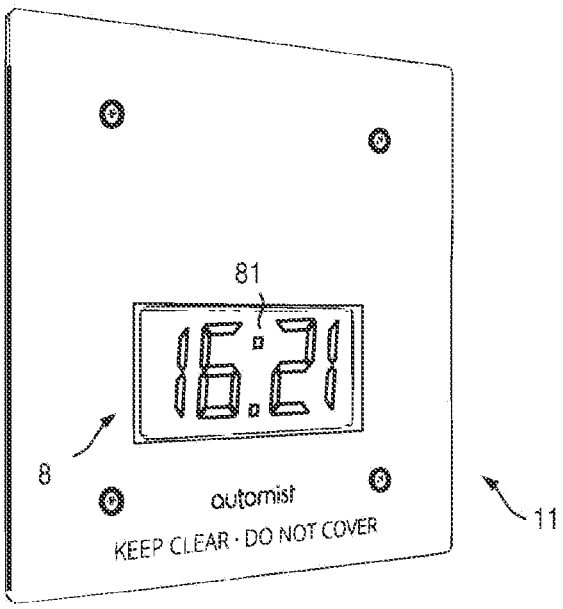
FIG. 19 illustrates a spray head unit having a first display.
Figure 20:
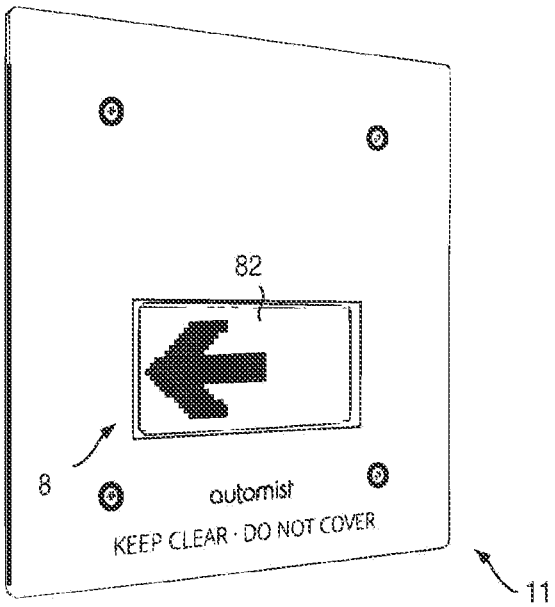
FIG. 20 illustrates a spray head unit having a second display.

Referring to FIGS. 19 and 20, the spray head assembly 8 may comprise a display 81, 82 mounted to one or more visible areas of the finished device (both the rotating and static elements are possible) which can be used to display useful information.

The display 81, 82 may be, for example, an OLED, LCD or electrophoretic ("e-Ink") display. The display 81, 82 not only affords a useful diagnostic/feedback function during installation and servicing, but also allows the spray heads in standby to provide useful ambient information to the householder, such as room temperature, weather, current time, sports results, social media information and so on. This display function provides an incentive to residents not to obstruct the spray head. In addition, during fire situations, the display can be programmed to display escape signage or other useful emergency information, as shown, for example in FIG. 20.

The spray head may comprise at least one touch- or proximity-sensitive input device (not shown) that can be used to interact with the system, either for configuration/servicing purposes, or for the user to interact with displayed ambient information (e.g. toggle between clock and room temperature or scroll through options), or for safety purposes to allow the user to confirm that the device is not obstructed. The input devices can be buttons, ultrasound sensors, infrared sensors, capacitive sensors or any suitable sensor type, there may be more than one such device, and there may be an input device capable of detecting inputs on different zones or positions of the spray head assembly.

Screen/touch interaction controls can be used to adjust a thermostat setting.

These display and data input elements allow a more useful and luxurious product to be created, adding value even if the system is never activated by a fire and also creating an incentive not to impair the function of the spray heads by obstruction, thus rendering the system more effective.

It will be appreciated that many modifications may be made to the embodiments hereinbefore described. Such modifications may involve equivalent and other features which are already known in the design, manufacture and use of wall-mountable spray head unit and/or injectors and fire-suppression system parts thereof and which may be used instead of or in addition to features already described herein. Features of one embodiment may be replaced or supplemented by features of another embodiment.

A water-based mixture or a non-aqueous fire suppressant liquid can be used instead of water. Other forms of communication may be used, such as RS-485.

Although claims have been formulated in this application to particular combinations of features, it should be understood that the scope of the disclosure of the present invention also includes any novel features or any novel combination of features disclosed herein either explicitly or implicitly or any generalization thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

The invention claimed is:

1. A wall-mountable spray head unit comprising:
a display and at least one user input device; and
a rotatable spray head assembly comprising:
a spray manifold rotatable about a first axis; and
a spray nozzle supported by the spray manifold and orientated to deliver fire suppressant material radially in a plane defined by the first axis and a second axis which is perpendicular to the first axis.

2. The wall-mountable spray head unit according to claim 1, further comprising:
at least one thermal sensor.

3. A wall-mountable spray head unit according to claim 1, wherein the display shows real-time information.

4. A wall-mountable spray head unit according to claim 3, wherein the real-time information is room temperature, weather, and/or current time.

5. A wall-mountable spray head unit according to claim 3, wherein the at least one user input device is for user interaction with the display.

6. A wall-mountable spray head unit according to claim 1, wherein the display shows emergency information.

7. A wall-mountable spray head unit according to claim 6, wherein the emergency information is escape signage.

8. A wall-mountable spray head unit according to claim 1, wherein the at least one user input device is for user interaction with the display.

9. A wall-mountable spray head unit according to claim 1, wherein the at least one user input device is a button or sensor.

10. A wall-mountable spray head unit according to claim 9, wherein the sensor is an ultrasound sensor, infrared sensor, or capacitive sensor.

11. A wall-mountable spray head unit according to claim 1, wherein the display is provided on a static part of the spray head unit.

12. A wall-mountable spray head unit according to claim 1, wherein the display is provided on a rotatable part of the spray head unit.

13. A fire suppression system comprising:
at least one wall-mountable spray head unit according to claim 1;
at least one pressure generator; and
at least one fire detector in wired or wireless communication with the spray head unit(s) and/or pressure generator.

14. A fire suppression system according to claim 13, wherein the system comprises a plurality of wall-mountable spray head units each installed in separate rooms.

15. A wall-mountable spray head unit comprising:
a display; and
a rotatable spray head assembly comprising:
a spray manifold rotatable about a first axis; and
a spray nozzle supported by the spray manifold and orientated to deliver fire-suppressant material radially in a plane defined by the first axis and a second axis which is perpendicular to the first axis.

* * * * *